US006158308A

United States Patent [19]

Huang

[11] Patent Number: 6,158,308

[45] Date of Patent: Dec. 12, 2000

[54] DOUBLE-SIDED RATCHET WRENCH HAVING A ONE-WAY REVERSING MECHANISM

[76] Inventor: Hsien-Tu Huang, No. 56, Min Sheng St., Feng-Yuan City, Taiwan, 42041

[21] Appl. No.: 09/312,925

[22] Filed: May 14, 1999

[51] Int. Cl.[7] ..... B25B 13/00

[52] U.S. Cl. ..... 81/58.3; 81/60

[58] Field of Search ..... 81/58, 58.3, 60; 192/43.1

[56] References Cited

U.S. PATENT DOCUMENTS

| | | | |
|---|---|---|---|
| 249,003 | 11/1881 | Cherry | 81/58.3 |
| 1,321,005 | 11/1919 | Bowman | 81/58.3 |
| 1,526,150 | 2/1925 | Jette | 81/58.3 |
| 2,733,745 | 2/1956 | Norwood | 81/58.3 |
| 2,797,599 | 7/1957 | McGarvie, Jr. | 81/58.3 |
| 4,479,409 | 10/1984 | Antonius | 81/58.3 |
| 4,939,961 | 7/1990 | Lee | 81/60 |

*Primary Examiner*—James G. Smith
*Assistant Examiner*—David B Thomas

[57] ABSTRACT

A double sided ratchet wrench having a one-way reversing mechanism is provided. The wrench includes a handle, a ring integrated with on end of the handle having an inner flange extending inward from a middle inner periphery on the underside of which forms a first ratchet, a first tip head having a hollow interior body inserted into the ring, a first outer flange and a thru hole in a side wall above the first outer flange, a second tip head having a solid body including a narrow upper portion inserted into the hollow interior body and a first spring biased steel ball in a lateral side engaged into the thru hole of the first tip head, a thick lower portion including a second spring biased steel ball in a lateral side for engaging with additional fastening tools, a second outer flange between the upper and lower portions having a second ratchet on the top engageable with the first ratchet of the ring and a compression spring disposed between the first tip head and the ring.

3 Claims, 5 Drawing Sheets

DOUBLE-SIDED RATCHET WRENCH HAVING A ONE-WAY REVERSING MECHANISM

BACKGROUND OF THE INVENTION

The present invention relates to wrenches and more particularly to a double-sided ratchet wrench having a one-way reversing mechanism which provides greater torque and durability in comparison with the conventional ratchet wrenches.

A typical ratchet wrench as shown in FIG. 1 includes a the handle 10, a ring 11 at one end of handle 10 into which an internal ratchet gear 12 disposes, a rectangular tip head 13 disposed at the center of the ring 11, a cylinder post 15 in the center of the rectangular tip head 13, a spring 151 biased in a peripheral recess of the post 15 with steel ball 152 at the outer end of the spring 151 and a pallet 14 pivoted between the internal ratchet gear 12 and the post 15. The pallet 14 has a pair of first and second toothed ends 141 and 142 engageable with the teeth of the internal ratchet gear 12 and a pair of notches 143 and 144 engageable with the steel ball 152. When the post 15 rotates counterclockwise, the steel ball 152 engages into the notch 144 so as to force the pallet 14 tilting at rightward that its second toothed end 142 engages with the ratchet gear 12. Since the internal ratchet gear 12 can only be racing counterclockwise in a predetermined span, it enables the tip head 13 to fasten a screw clockwise.

FIG. 2 shows another typical ratchet wrench which includes a handle 20, a ring 21 at one end of the handle 20, an external ratchet gear 22 integrated with a tip head 23 disposed into the ring 21, a spring biased steel ball 231 disposed in a lateral side of the tip head 23 for enabling the tip head 23 to engage with a box, an arcuate pallet 24 pivoted between the ratchet gear 22 and the handle 20 including a first and a second angled ends 241 and 242 and a pair of notches 243 and 244 which are engageable with a spring 26 biased steel ball 27 in a center bore 25 of the handle 20. When the pallet 24 is turned clockwise, its second angled end 242 engages with the ratchet gear 22 so that the gear 22 can only be racing clockwise to enabling the tip head 23 to fasten a screw counterclockwise. Contrarily, if the pallet 24 turns counterclockwise and its first angled end 241 engages with the ratchet gear 22 which can only be racing counterclockwise so as to enabling the tip head 23 to fasten a screw clockwise.

However, both the above ratchet wrenches have the following disadvantages:

a) it could not provide greater torque unless the pallet would be breakable;

b) both the ratchet gear and the pallet will become weary and abraded after a certain period of use;

c) structurally complicated;

d) the ring becomes too heavy after the tip head engages with additional parts that causes the wrench inconvenient to operate.

SUMMARY OF THE PRESENT INVENTION

The present invention has a main object to provide a structurally improved double-sided ratchet wrench which includes a first tip head and a second tip head inserted into the first tip head wherein the second tip head has a first ratchet surface engaged with a second ratchet surface in a ring at the end of a handle of the wrench with a compressed spring biased thereinbetween so that the ratchet of the second tip head can be racing clockwise to enable the second tip head to fasten a screw counterclockwise and the first tip head to fasten a screw clockwise.

Another object of the present invention is to provide a structurally improved double-side ratchet wrench which is durable and provide greater torque in comparison with the above prior art ratchet wrenches.

The present invention will become more fully understood by reference to the following detailed description thereof when read in conjunction with the attached drawings.

DETAILED DESCRIPTION OF THE PREFERRED EMBODIMENT

Figure 1:
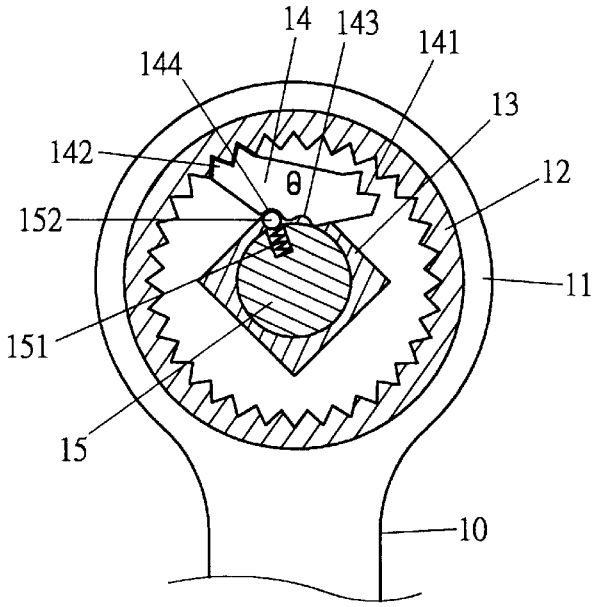
FIG.1 (Prior Art)
FIG. 1 and 2 are the sectional view to show a pair of ratchet wrenches according to the prior art.
Figure 2:
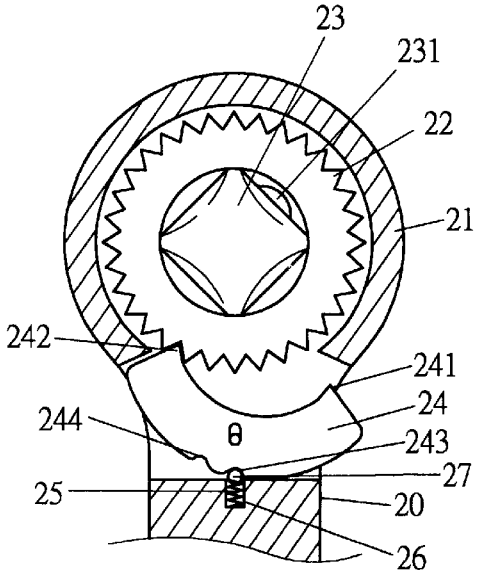
FIG.2 (Prior Art)
Figure 3:
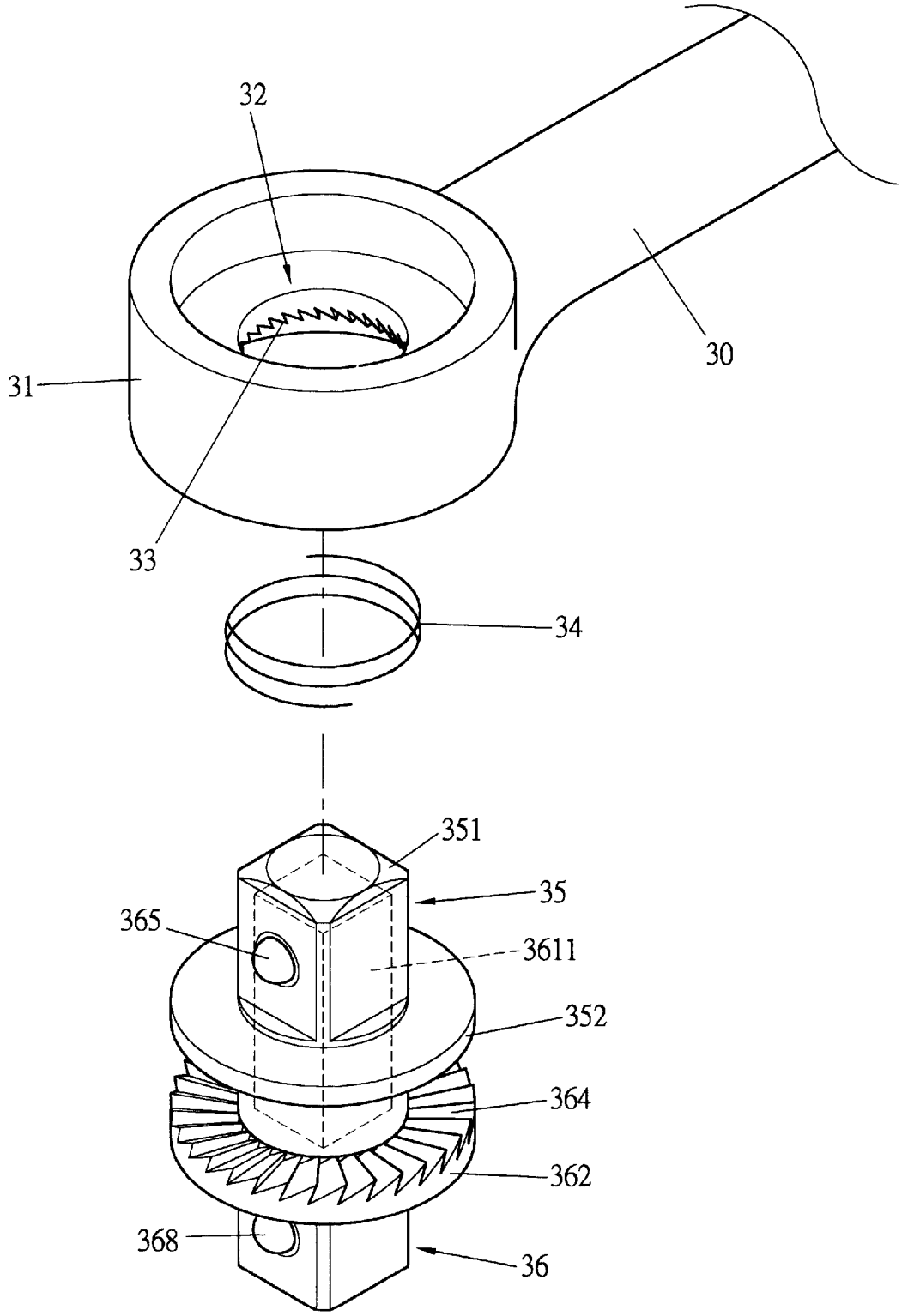
FIG. 3 is an exploded perspective view to show a preferred embodiment according to the present invention.

With reference to FIGS. 3 to 6 of the drawings, the double-sided ratchet wrench of the present invention comprises generally a handle 30, a ring 31 integrated with one end of the handle 30, an annular flange 32 extended inward from a middle inner periphery of the ring 31, a first ratchet 33 or serration formed around the bottom surface of the flange 32, a first tip head and a second tip head 35 and 36 disposed into the ring 31 with a compression spring 34 biased therebetween.

The first tip head 35 has a hollow interior rectangular body 351 slidably engageable into a central bore defined by the flange 32, a first outer flange 352 extendedoutward fromamiddle outer surface of the body 351 engageable into the ring 31 and a thru hole 354 formed in a lateral wall of the body 351 above the first outer flange 352.

The second tip head 36 has a solid rectangular body 361 including a narrow upper portion 3611 engageable into the hollow interior of the rectangular body 351 of the first tip head 35 and a thick lower portion 3612, a second outer flange 362 extended outward from a lateral side under the narrow upper portion 3611 engageable into the ring 31 including a second ratchet 364 engageable with the first ratchet 33 of the ring 31, a first transverse cavity 363 formed in a lateral side of the narrow upper portion 3611 into which a first steel ball 365 is disposed and biased by a first small spring 366 and a second transverse cavity 367 formed in a lateral side of the thick lower portion 3612 into which a second steel ball 368 is disposed and biased by a second small spring 369. The second steel ball 368 is prepared solely for engaging the thick lower portion 3612 with a box or other additional equivalents.

When assembling, first, sleeve the compression spring 34 on the hollow interior rectangular body of the first tip head 35 beneath the first outer flange 352 and axially dispose the first tip head 35 into the ring 31, then insert the narrow portion 3611 of the second tip head 36 in place into the hollow interior of the first tip head 35 until that the first steel ball engaged into the thru hole 354 of the first tip head 35.

Figure 4:
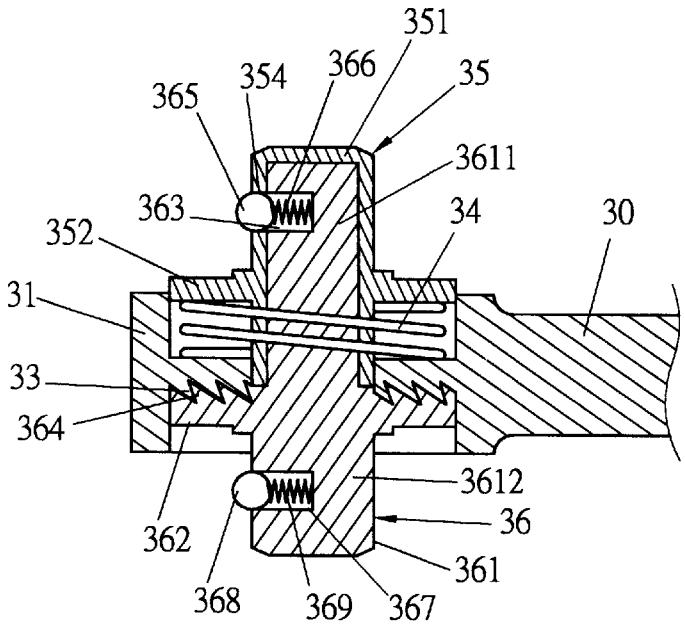
FIG. 4 is a sectional view to show the assembly of FIG. 3.
Figure 5:
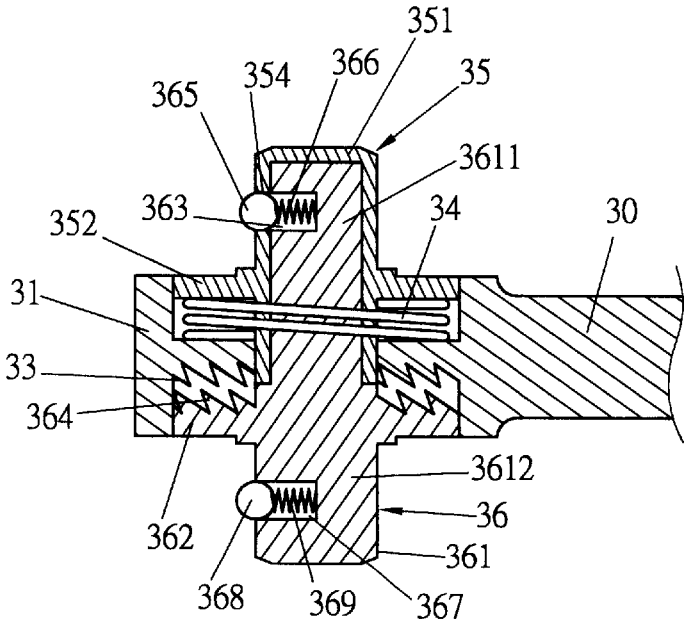
FIG. 5 is a sectional view of FIG. 4 when the second tip head is racing.

This time, the second ratchet 364 of the second tip head 36 automatically engages with the first ratchet 33 of the ring 31 under the resilience of the compression spring 34 (as shown in FIG. 4), If press the first tip head 35 downward, the second ratchet 364 will disengage with the first ratchet 33 (as shown in FIG. 5).

Figure 6:
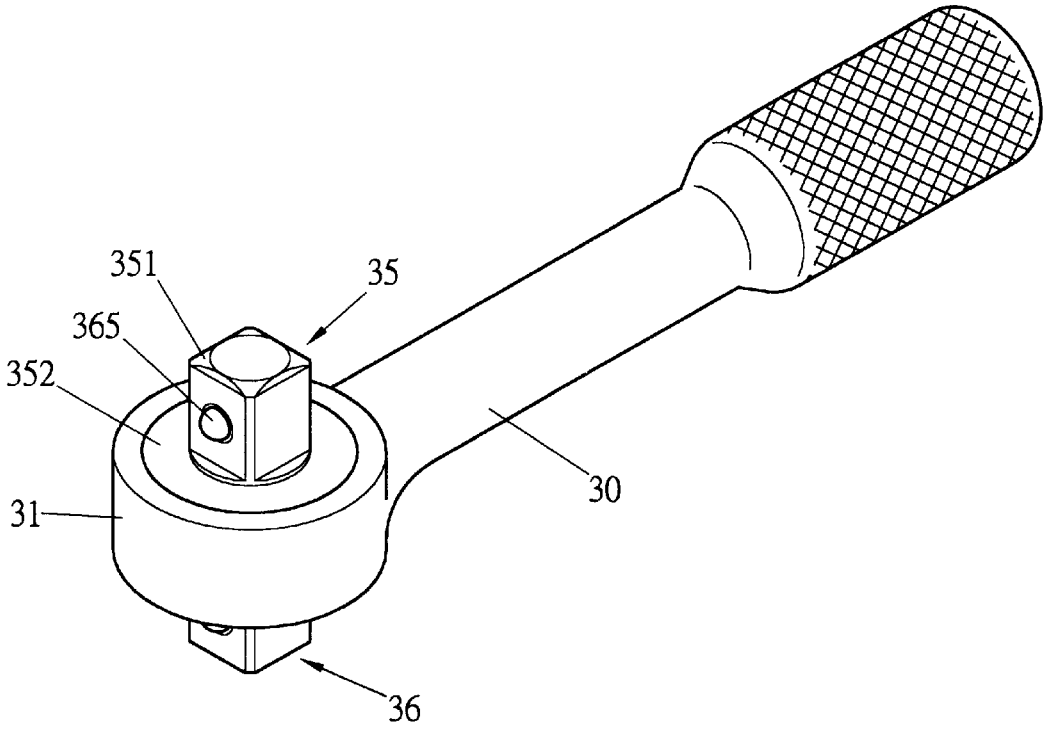
FIG. 6 is a perspective view of the ratchet wrench of the present invention.

FIG. 6 show a well assembled ratchet wrench of the present invention, when fasten a screw clockwise, the second tip head 36 is used because the second ratchet 364 is racing counterclockwise with the first ratchet 33. If unfasten a screw, the first tip head 35 is used because it provides counterclockwise torque force. Besides, both the first and second tip head 35 and 36 can engage with additional fastening tools such as a box and/or equivalents.

Accordingly, the ratchet wrench of the present invention is characterized in simple arrangement and durable structure which provides greater torque in comparison with the prior art ratchet wrenches. This arrangement can be also adaptable to other fastening tool such as a screwdriver.

Figure 7:
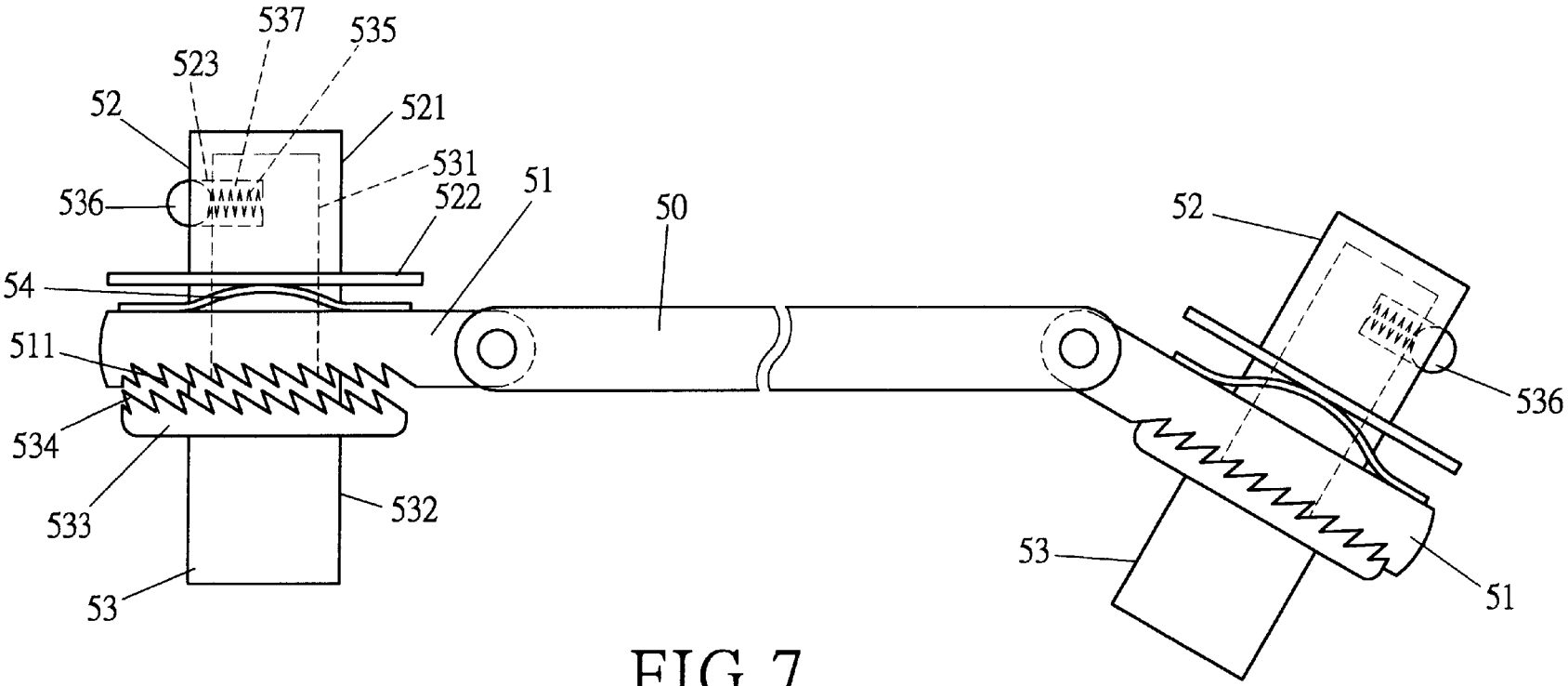
FIG. 7 is a side view to show another preferred embodiment of the present invention.

Referring to FIG. 7, an alternative embodiment of an ratchet wrench of the present invention is provided which comprises a handle 50, a ring 51 pivoted to each end of handle 50 so that the wrench is collapsible, a first ratchet 511 or serration formed around the underside of the ring 51, a first tip head 52, a second tip head 53 and an annular spring plate 54.

The first tip head 52 has a hollow interior body 521, an outer flange 522 extended outward from a middle outer periphery and a thru hole 533 formed in a lateral wall of the body 521 above the flange 522.

The second tip head 53 has a solid body including a narrow upper portion 531 insertible into the hollow interior body 521 of the first tip head 52 and a thick lower portion 532, a second outer flange 533 extended outward from an outer wall between the upper and lower portions 531 and 532, a ratchet 534 formed around the top of the flange 533 engageable with the first ratchet 511 of the ring 51 and a transverse cavity 535 in a lateral side of the narrow portion 531 for receiving a steel ball 536 which is biased by a spring 537.

When assembling, first, sleeve the annular spring plate 54 on the hollow interior body 521 of the first tip head 52 beneath the first outer flange 522 and insert the body 521 into the ring 51 from the top of the ring 51, then insert the narrow portion 531 of the body of the second tip head 53 into the hollow interior body 521 of the first tip head 52 from the underside of the ring 51 until that the steel ball 536 engaged into the thru hole 523 of the first tip head 52. This time, the second ratchet 534 of the second tip head 53 will automatically engage with the first ratchet 511 of the ring under the resilience of the spring plate 54.

This embodiment has a function similar to the above embodiment as described in FIGS. 3–6 and the above discussions are applicable in most instances. However, this embodiment provides more simple structure and is collapsible.

The specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. An allen wrench comprising:

a handle;

a ring integrated with one end of the handle and including an inner flange extending inward from a middle inner periphery of the ring to define a central bore therein-between and a first ratchet formed around underside of the inner flange;

a first tip head having a hollow interior rectangular body engageable into the central bore of the ring, a first outer flange extending outward from a middle outer wall of the body and engageable into the ring above the inner flange with a compression spring disposed therebetween, and a thru hole formed in a lateral wall of the body above the first outer flange;

a second tip head having a solid rectangular body including a narrow upper portion inserted into the hollow interior rectangular body of the first tip head from the underside of the ring, said narrow upper portion having a first transverse cavity for receiving a first steel ball biased by a first spring means which is engaged into the thru hole when the narrow upper portion is inserted in place into the hollow interior body of the first tip head, a thick lower portion, a second outer flange extending outward from an outer wall between the upper and lower portions and engageable into the ring from underside of the ring, a second ratchet formed around top of the second outer flange and engaged with the first ratchet of the inner flange of the ring and a second transverse cavity formed in a lateral side of the thick lower portion for receiving a second steel ball which is biased by a second spring means;

whereby, said first tip head fastens a screw counterclockwise and said second tip head fastens a screw clockwise.

2. The ratchet wrench as recited in claim 1 wherein said first and second tip heads can engage with additional fastening tools.

3. An allen wrench comprising:

a handle;

a ring pivoting on each end of the handle and having a first ratchet formed around underside thereof;

a first tip head having a hollow interior body inserted into the ring from top of the ring, an first outer flange extending outward from a middle periphery of the body engageable with the ring and a transverse hole formed in a lateral peripheral wall above the first outer flange;

a second tip head having a solid body including a narrow upper portion inserted into the hollow interior body, a steel ball biased by a spring means in a transverse cavity in a lateral side of the narrow portion engaged into the thru hole of the first tip head, a thick lower portion and a second outer flange extending outward from an outer periphery between the upper and lower portions on top of which a second ratchet is formed therearound and engageable the first ratchet of the ring;

an annular spring plate disposed between the first outer flange of the first tip head and the ring for providing resilience to enable an elastic engagement between the first and second ratchet.

* * * * *